US011998786B2

(12) United States Patent
Tsai et al.

(10) Patent No.: US 11,998,786 B2
(45) Date of Patent: Jun. 4, 2024

(54) MULTI-FUNCTIONAL FITNESS DEVICE

(71) Applicant: Zhangzhou Jinhong Fitness Equipment Co., Ltd., Zhangzhou (CN)

(72) Inventors: Yu-Lun Tsai, Zhangzhou (CN); Yang Li, Zhangzhou (CN)

(73) Assignee: Zhangzhou Jinhong Fitness Equipment Co., Ltd., Zhangzhou (CN)

( * ) Notice: Subject to any disclaimer, the term of this patent is extended or adjusted under 35 U.S.C. 154(b) by 181 days.

(21) Appl. No.: 17/894,479

(22) Filed: Aug. 24, 2022

(65) Prior Publication Data

US 2023/0381566 A1 Nov. 30, 2023

(30) Foreign Application Priority Data

May 27, 2022 (CN) ..... 202221290378.6

(51) Int. Cl.
*A63B 21/00* (2006.01)
*A63B 37/00* (2006.01)

(52) U.S. Cl.
CPC .... *A63B 21/00043* (2013.01); *A63B 21/4035* (2015.10); *A63B 21/4047* (2015.10); *A63B 37/0098* (2013.01)

(58) Field of Classification Search
CPC ..... A63B 22/03; A63B 22/16; A63B 23/1236
See application file for complete search history.

(56) References Cited

U.S. PATENT DOCUMENTS 3,352,559 A * 11/1967 Larsen ..... A63B 69/3667 482/146
3,862,768 A * 1/1975 England ..... A63B 21/0004 482/146
4,191,371 A * 3/1980 Armer, Jr. ..... A63B 22/18 482/77
5,613,690 A * 3/1997 McShane ..... G06F 3/0334 428/902
6,168,551 B1 * 1/2001 McGuinness ..... A63B 69/0093 482/146

(Continued)

FOREIGN PATENT DOCUMENTS

BR 102014031710 A2 * 6/2016
CN 115382162 A * 11/2022
WO WO-2016026047 A1 * 2/2016 ..... A63B 21/0004

*Primary Examiner* — Nyca T Nguyen
(74) *Attorney, Agent, or Firm* — Cooper Legal Group, LLC

(57) ABSTRACT

A multi-functional fitness device comprises a first supporting seat, a second supporting seat and a sphere. The first supporting seat and the second supporting seat are respectively provided with a first concave spherical surface and a second concave spherical surface matched with an outline of the sphere, and are oppositely arranged, with the sphere supported therebetween, two sides of the sphere are partially fitted and embedded into the first concave spherical surface and the second concave spherical surface respectively, at least one of the first supporting seat and the second supporting seat is movably connected to a surface of the sphere through the corresponding first concave spherical surface or second concave spherical surface, and adhered to the surface of the sphere to move, and an elastic member is connected between at least one opposite side edges of the first supporting seat and the second supporting seat.

10 Claims, 14 Drawing Sheets

(56) References Cited

U.S. PATENT DOCUMENTS 7,288,055 B2 * 10/2007 Blaum ..... A63B 22/18 482/142
7,566,291 B2 * 7/2009 Lickle ..... A63B 26/003 482/79
7,775,952 B1 * 8/2010 Curran ..... A63B 41/00 482/146
7,993,253 B2 * 8/2011 Fernandez ..... A63B 22/18 482/146
9,079,072 B2 * 7/2015 Agostini ..... A63B 21/0004
9,387,363 B1 * 7/2016 Polinsky ..... A63B 26/003
10,561,895 B1 * 2/2020 Lee ..... A63B 22/18
2004/0224824 A1 * 11/2004 Lickle ..... A63B 69/0093 482/148
2005/0101441 A1 * 5/2005 Rosborough ..... A63B 22/16 482/79
2006/0211553 A1 * 9/2006 Cantor ..... A63B 21/0004 482/79
2007/0207906 A1 * 9/2007 Blaum ..... A63B 22/18 482/146
2007/0298947 A1 * 12/2007 Eksteen ..... A63B 22/20 482/141
2009/0197748 A1 * 8/2009 Smith ..... A63B 22/18 482/146
2010/0093506 A1 * 4/2010 Aigner ..... A63B 22/18 482/146
2013/0116100 A1 * 5/2013 Chen ..... A63B 22/18 482/146
2013/0296147 A1 * 11/2013 Cruz ..... A63B 69/0093 482/146
2014/0155236 A1 * 6/2014 Curry ..... A63B 23/04 482/146
2016/0193504 A1 * 7/2016 Ambrozak ..... A63B 26/003 482/146
2017/0304675 A1 * 10/2017 Panes ..... A63B 23/0216
2023/0149773 A1 * 5/2023 Defore ..... A63C 17/012 482/146

* cited by examiner

MULTI-FUNCTIONAL FITNESS DEVICE

RELATED APPLICATIONS

This application claims priority to Chinese Patent Application 202221290378.6, filed on May 27, 2022, which is incorporated herein by reference.

TECHNICAL FIELD

The present invention relates to the technical field of fitness equipment, and particularly to a multi-functional fitness device.

BACKGROUND

A multi-functional fitness device in the prior art is usually complicated in overall structure and expensive in price when exercise requirements of multiple parts of body are taken into account, while fitness equipment with simple structure and low price is difficult to take into account the exercise requirements of multiple parts such as arms, an abdomen, legs and feet, thus being difficult to meet diversified exercise requirements of an exerciser.

SUMMARY

Aiming at the defects of the prior art, the present invention provides a multi-functional fitness device, which has the advantages of simple overall structure and convenient use, and can meet training requirements of multiple parts such as arms, an abdomen, legs and feet of an exerciser.

In order to achieve the object above, the present invention is realized by the following technical solutions.

A multi-functional fitness device comprises a first supporting seat, a second supporting seat and a sphere, wherein the first supporting seat and the second supporting seat are respectively provided with a first concave spherical surface and a second concave spherical surface matched with an outline of the sphere, the first supporting seat and the second supporting seat are oppositely arranged, the sphere is supported between the first supporting seat and the second supporting seat, two sides of the sphere are partially fitted and embedded into the first concave spherical surface and the second concave spherical surface respectively, at least one of the first supporting seat and the second supporting seat is configured to be movably connected to a surface of the sphere through the corresponding first concave spherical surface or second concave spherical surface, and adhered to the surface of the sphere to move with a center of the sphere as a movement center, and an elastic member capable of generating an elastic contraction force is connected between at least one opposite side edges of the first supporting seat and the second supporting seat.

Further, two sides of the first supporting seat are respectively provided with a first supporting portion and a second supporting portion, two sides of the second supporting seat are respectively provided with a third supporting portion and a fourth supporting portion, the first supporting portion and the third supporting portion are oppositely arranged, the second supporting portion and the fourth supporting portion are oppositely arranged, and the elastic member is connected between the first supporting portion and the third supporting portion or between the second supporting portion and the fourth supporting portion.

Further, the first supporting portion, the second supporting portion, the third supporting portion and the fourth supporting portion are all provided with an arc-shaped concave structure convenient for supporting arms of a human body.

Further, the arc-shaped concave structures of the first supporting portion, the second supporting portion, the third supporting portion and the fourth supporting portion are all provided with a flexible pad.

Further, the first supporting portion, the second supporting portion, the third supporting portion and the fourth supporting portion are all provided with an opening structure convenient for grasping.

Further, a movement trend of mutual approaching and closing formed by the elastic contraction force of the elastic member is configured between the first supporting portion and the third supporting portion or between the second supporting portion and the fourth supporting portion.

Further, the first concave spherical surface and the second concave spherical surface are respectively provided with a first embedding groove and a second embedding groove for embedding the elastic member, and the first supporting seat and the second supporting seat are also respectively provided with a first fixed clamping position and a second fixed clamping position for fixing end portions of the elastic member.

Further, a diameter of the sphere is defined as D, and an embedding depth H of the sphere in the first concave spherical surface or the second concave spherical surface is configured as 0.1 D to 0.25 D.

Further, the sphere is a hard spherical structure.

Further, the elastic member is an elastic rope or an elastic belt, and two ends of the elastic member are both provided with a spherical head for fixing.

The technical solutions above have at least the following advantages and beneficial effects.

In the multi-functional fitness device of the present invention, the multi-functional fitness device is provided with the oppositely arranged first supporting seat and second supporting seat, which are supported by the sphere therebetween, and at least one of the first supporting seat and the second supporting seat is movably connected to the surface of the sphere through the corresponding first concave spherical surface or second concave spherical surface, and can be adhered to the surface of the sphere to move with the center of the sphere as the movement center. A movement mode of the supporting seat comprises that two opposite sides of the first supporting seat and the second supporting seat may be opened or closed, or the first supporting seat and the second supporting seat may be relatively twisted. Meanwhile, the elastic member capable of generating the elastic contraction force is connected between the opposite side edges of the first supporting seat and the second supporting seat, so as to generate a resistance to movement and a reset force for the relative movement of the first supporting seat and the second supporting seat on the sphere. The multi-functional fitness device has a simple and useful overall structure, and there are various exercise modes between the first supporting seat and the second supporting seat, so that an exerciser may use the multi-functional fitness device for various exercises.

DESCRIPTIONS OF REFERENCE NUMERALS

Figure 1:
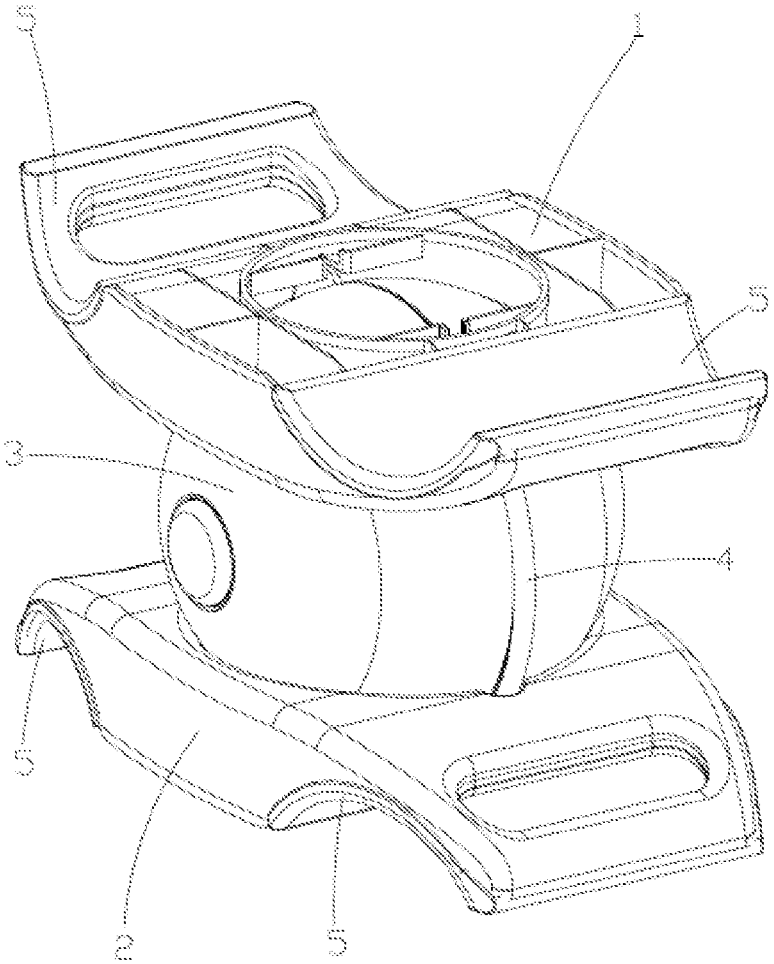
FIG. 1 is a schematic diagram of a stereoscopic structure of a multi-functional fitness device according to an embodiment of the present invention.

1 refers to first supporting seat, 2 refers to second supporting seat, 3 refers to sphere, 4 refers to elastic member, 5 refers to flexible pad, 11 refers to first concave spherical surface, 12 refers to first supporting portion, 13 refers to second supporting portion, 14 refers to first fixed clamping position, 21 refers to second concave spherical surface, 22 refers to third supporting portion, 23 refers to fourth supporting portion, 24 refers to second fixed clamping position, 41 refers to spherical head, 111 refers to first embedding groove, and 211 refers to second embedding groove.

DETAILED DESCRIPTION OF THE EMBODIMENTS

The present invention is further described hereinafter with reference to the drawings and the embodiments.

In the description of the present invention, it should be understood that the orientation or position relationship indicated by the terms "up", "down", "front", "rear", "left", "right", "top", "bottom", "inside", "outside", and the like is based on the orientation or position relationship shown in the drawings, it is only for the convenience of description of the present invention and simplification of the description, and it is not to indicate or imply that the indicated device or element must have a specific orientation, and be constructed and operated in a specific orientation. Therefore, the terms should not be understood as limiting the present invention.

Figure 2:
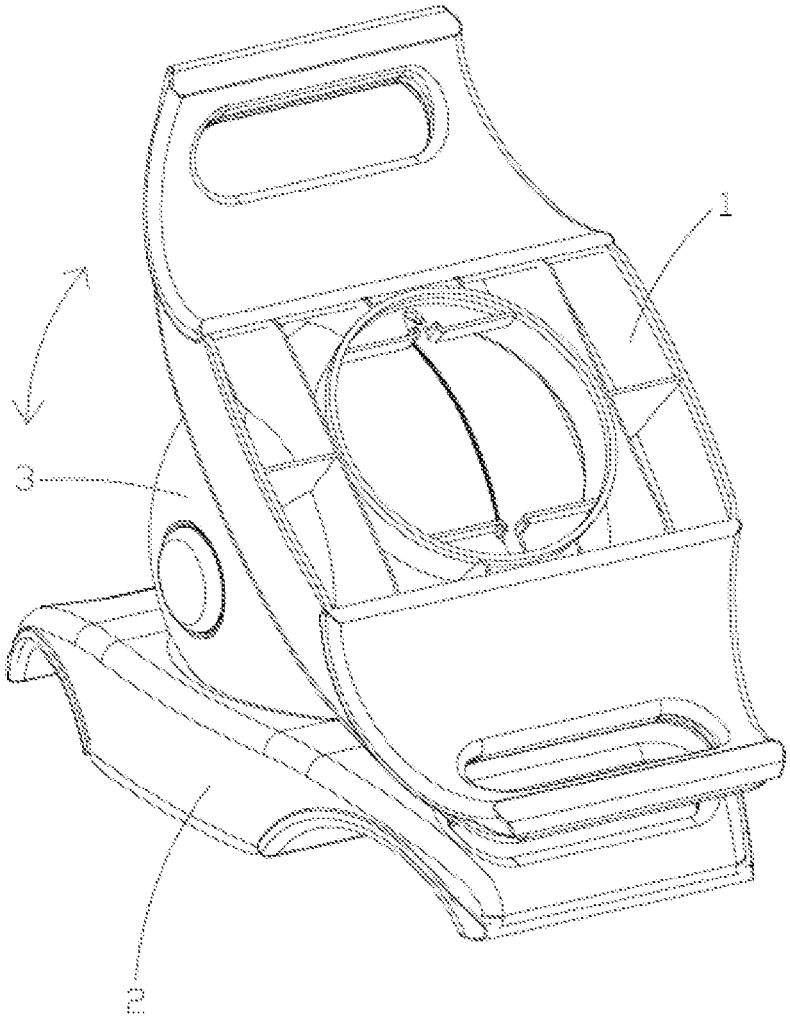
FIG. 2 is a first schematic diagram of a movement state of the multi-functional fitness device according to the embodiment of the present invention.
Figure 3:
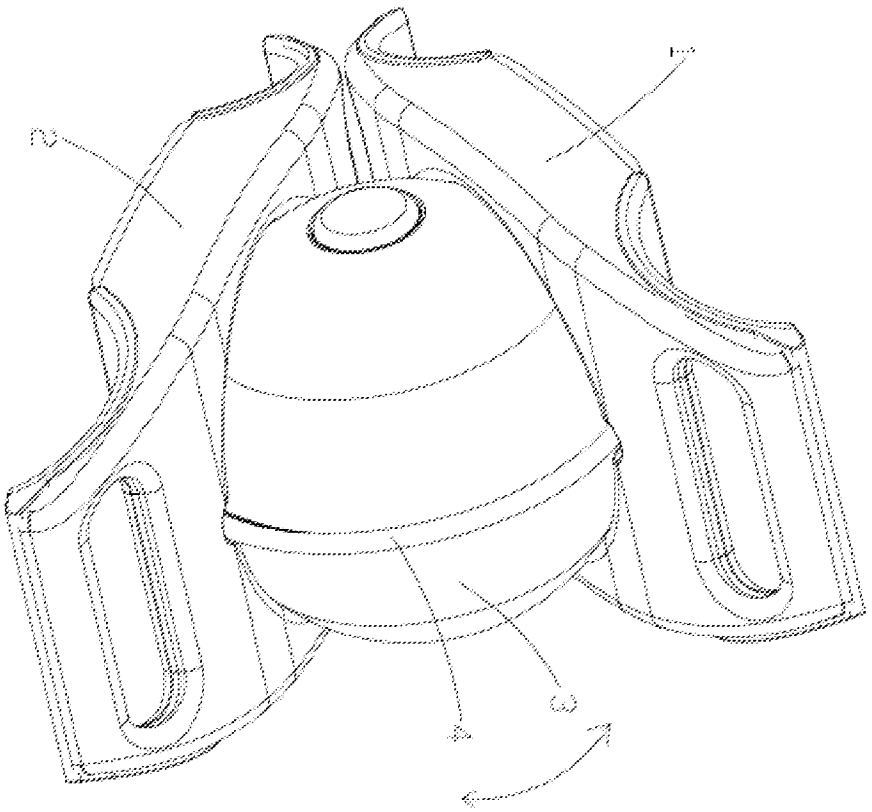
FIG. 3 is a second schematic diagram of the movement state of the multi-functional fitness device according to the embodiment of the present invention.
Figure 4:
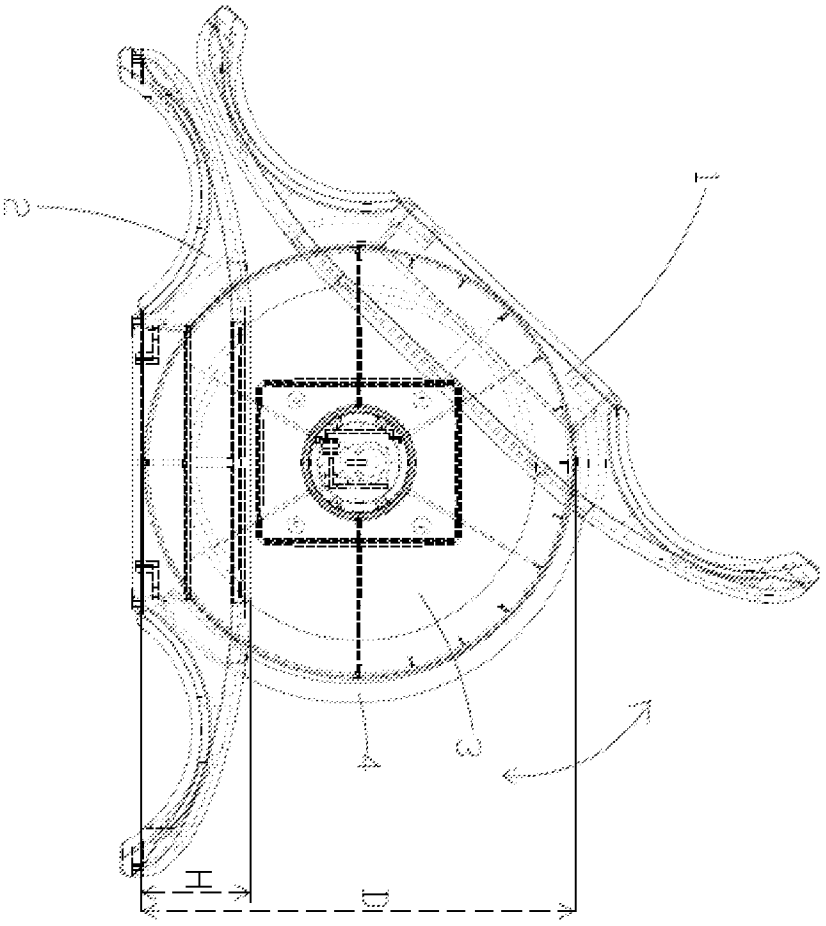
FIG. 4 is a sectional view of the structure of the multi-functional fitness device in FIG. 3.
Figure 5:
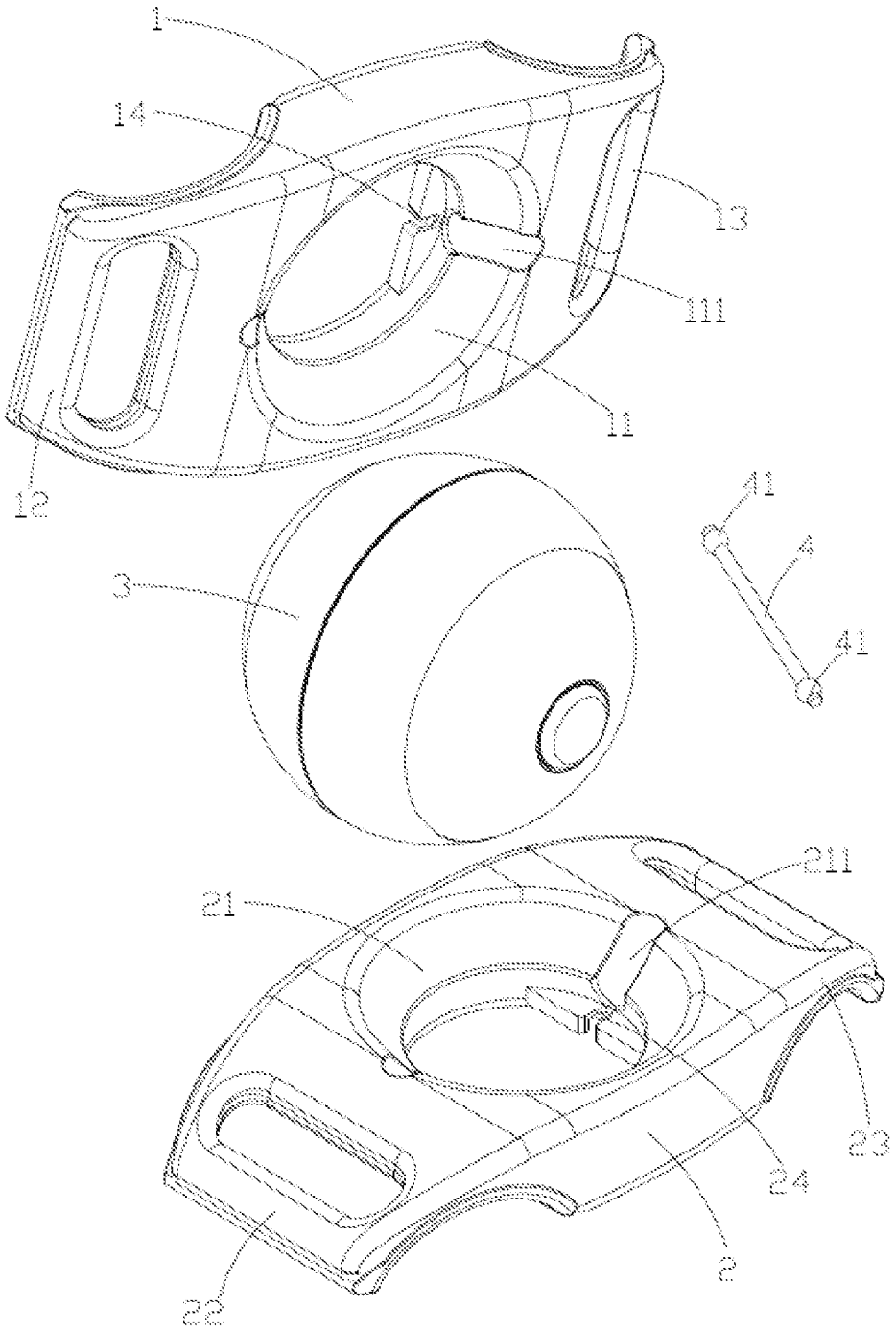
FIG. 5 is an exploded view of the stereoscopic structure of the multi-functional fitness device according to the embodiment of the present invention.
Figure 6:
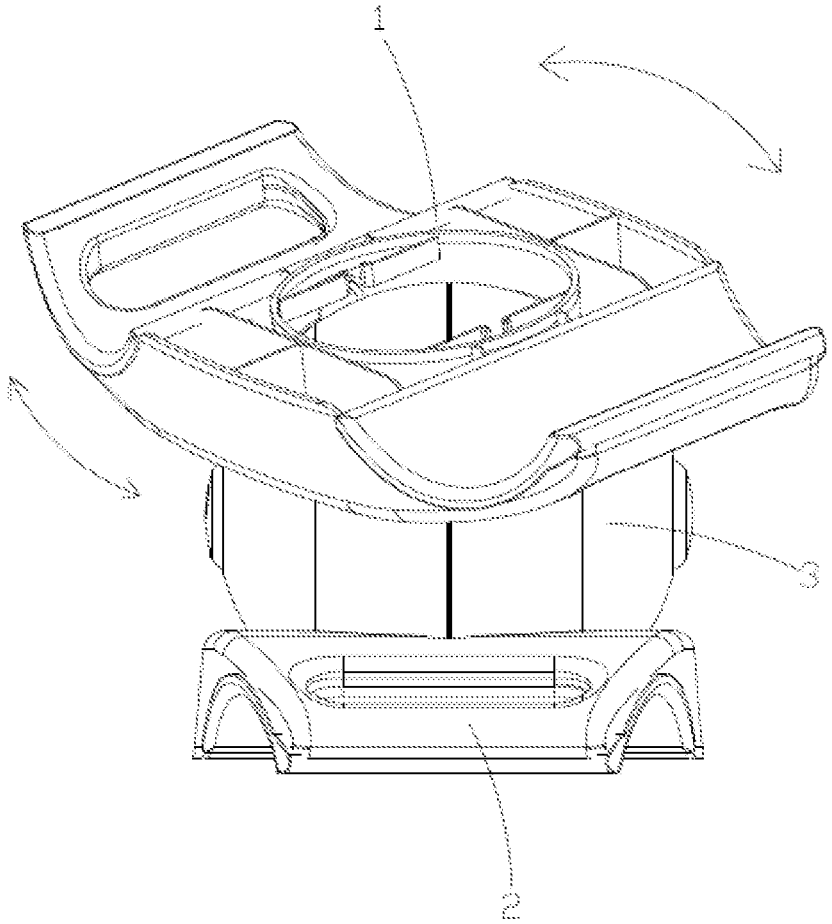
FIG. 6 is a third schematic diagram of the movement state of the multi-functional fitness device according to the embodiment of the present invention.
Figure 7:
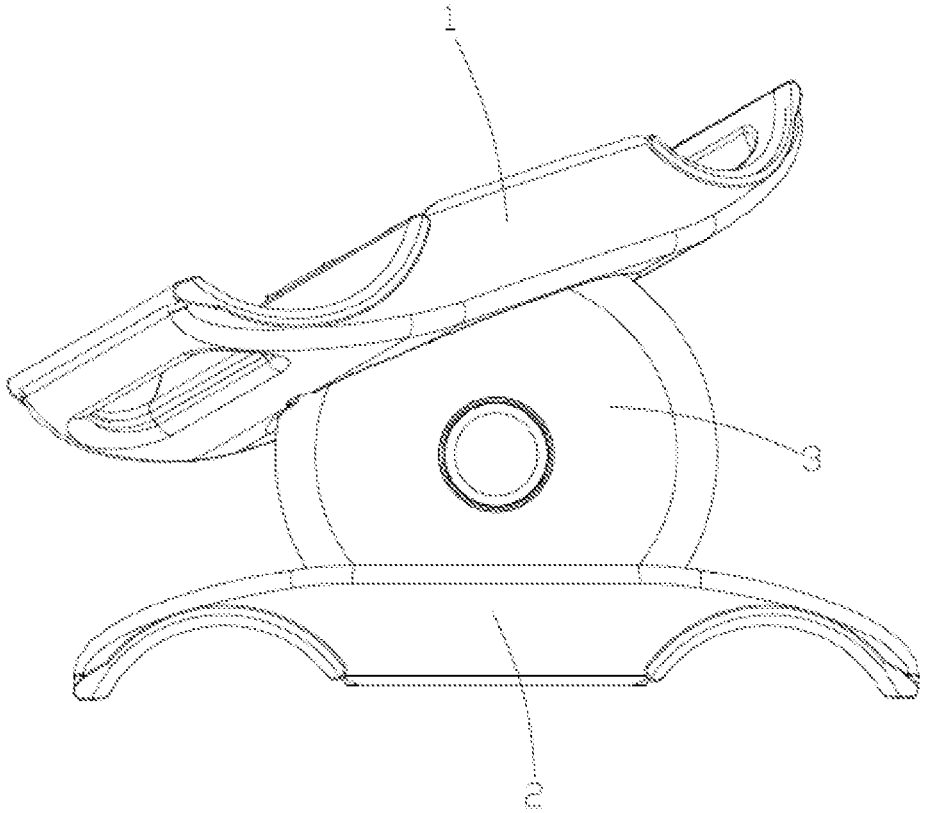
FIG. 7 is a fourth schematic diagram of the movement state of the multi-functional fitness device according to the embodiment of the present invention.
Figure 8:
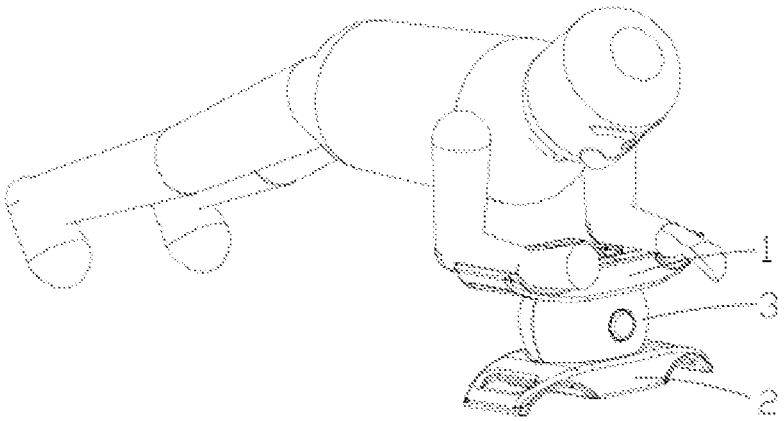
FIG. 8 is a first schematic diagram of a use state of the multi-functional fitness device according to the embodiment of the present invention.
Figure 9:
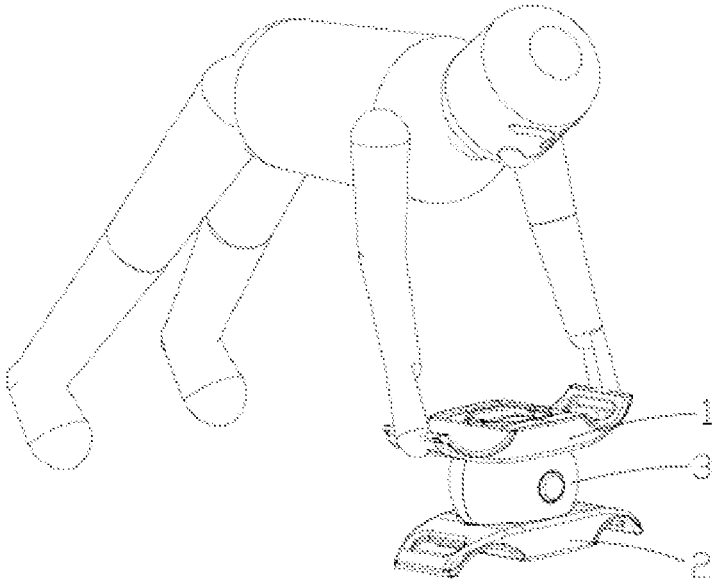
FIG. 9 is a second schematic diagram of the use state of the multi-functional fitness device according to the embodiment of the present invention.
Figure 10:
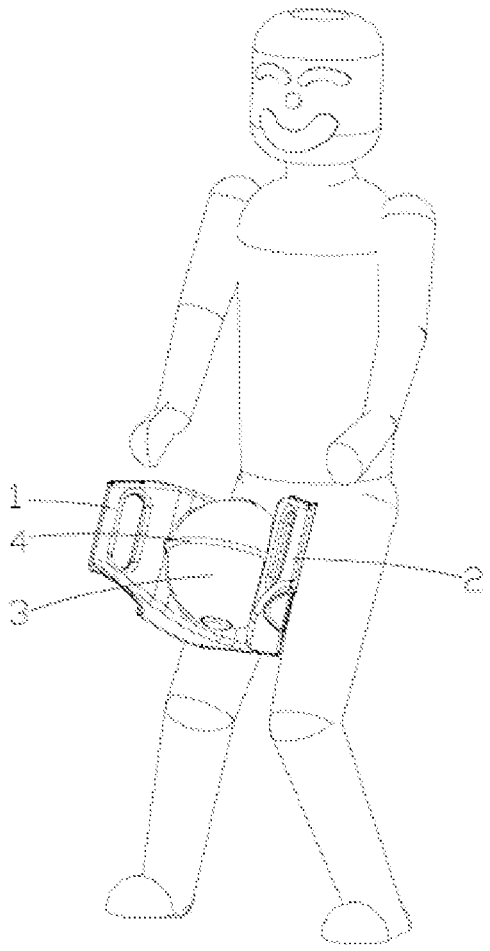
FIG. 10 is a third schematic diagram of the use state of the multi-functional fitness device according to the embodiment of the present invention.
Figure 11:
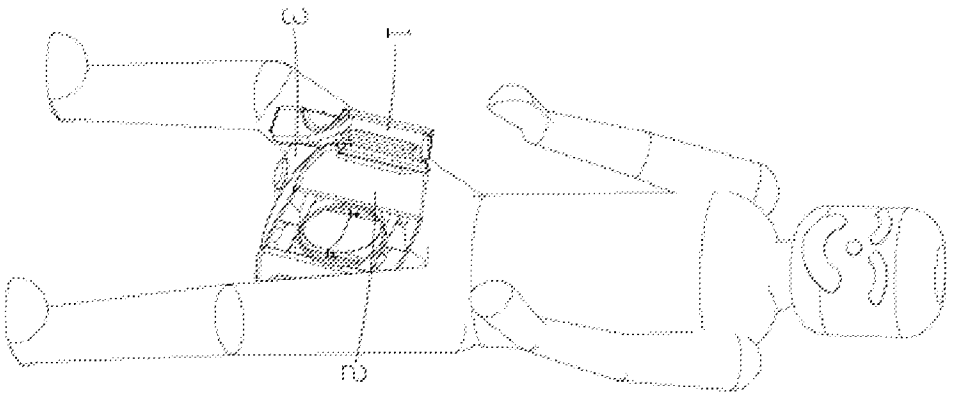
FIG. 11 is a fourth schematic diagram of the use state of the multi-functional fitness device according to the embodiment of the present invention.
Figure 12:
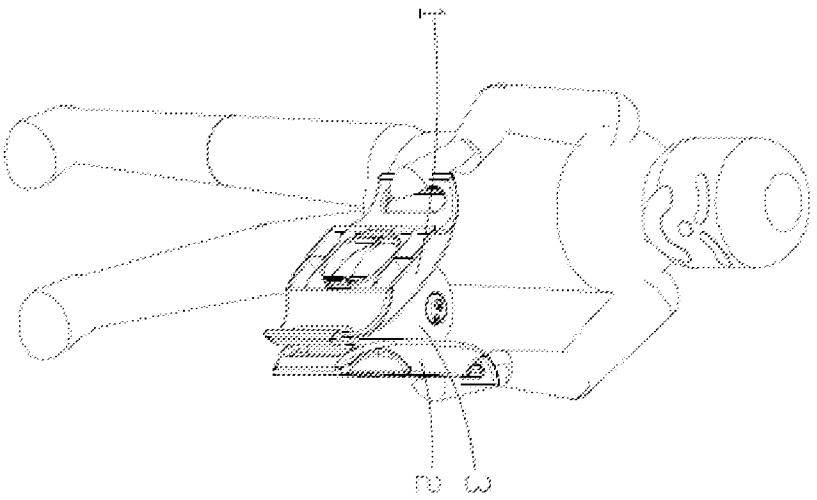
FIG. 12 is a fifth schematic diagram of the use state of the multi-functional fitness device according to the embodiment of the present invention.
Figure 13:
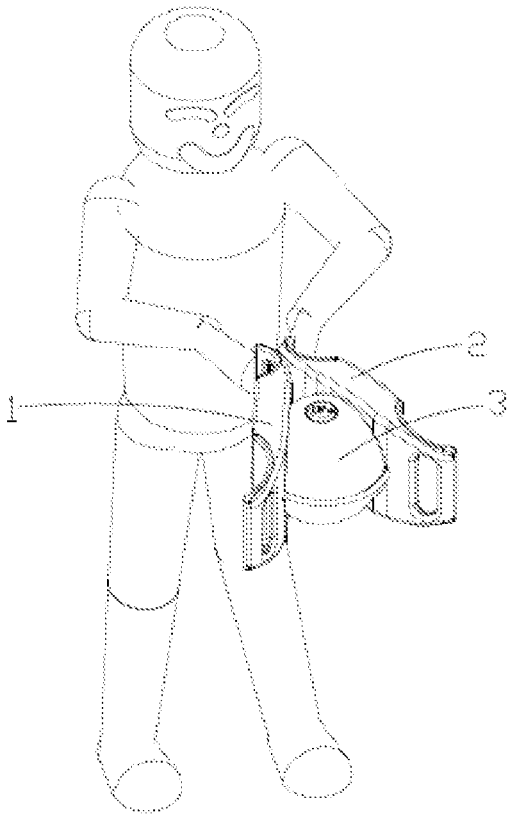
FIG. 13 is a sixth schematic diagram of the use state of the multi-functional fitness device according to the embodiment of the present invention.
Figure 14:
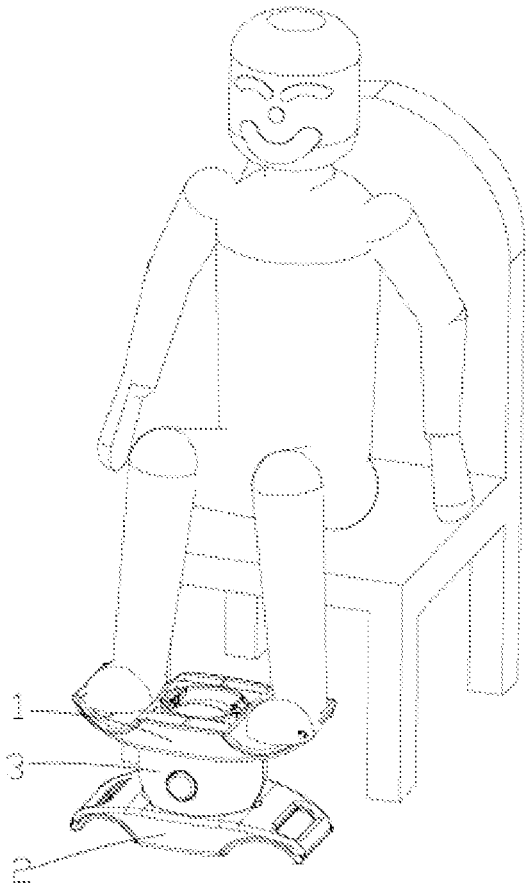
FIG. 14 is a seventh schematic diagram of the use state of the multi-functional fitness device according to the embodiment of the present invention.
Figure 15:
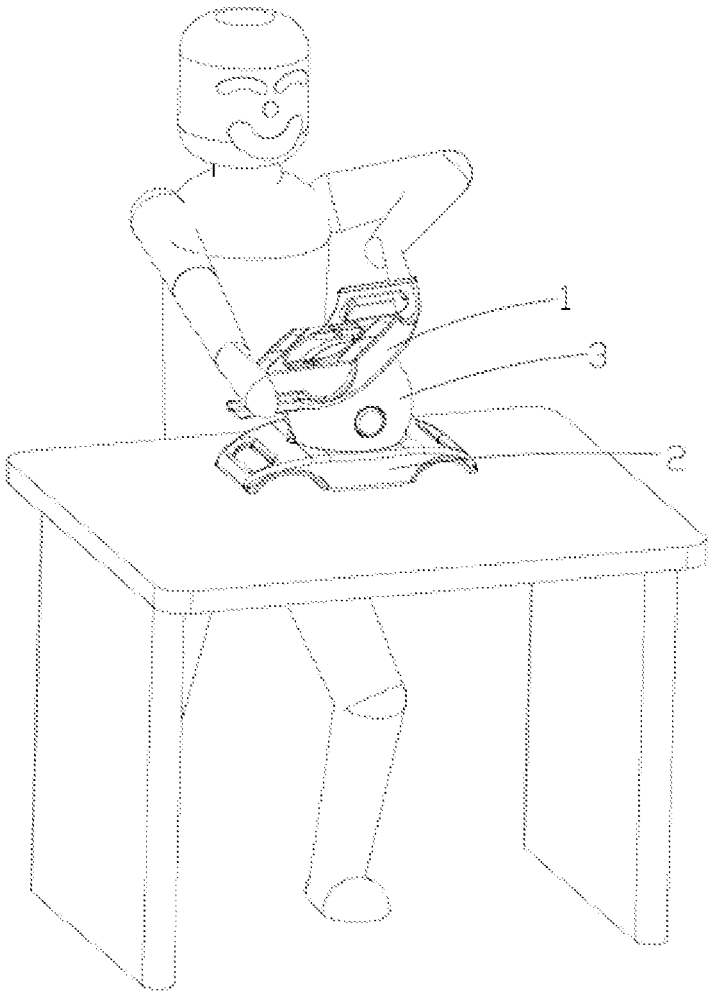
FIG. 15 is an eighth schematic diagram of the use state of the multi-functional fitness device according to the embodiment of the present invention.

With reference to FIG. 1 to FIG. 7, a multi-functional fitness device provided by an embodiment of the present invention comprises a first supporting seat 1, a second supporting seat 2 and a sphere 3. The first supporting seat 1 and the second supporting seat 2 are respectively provided with a first concave spherical surface 11 and a second concave spherical surface 21 matched with an outline of the sphere 3, the first supporting seat 1 and the second supporting seat 2 are oppositely arranged, the sphere 3 is supported between the first supporting seat 1 and the second supporting seat 2, and two sides of the sphere 3 are partially fitted and embedded into the first concave spherical surface 11 and the second concave spherical surface 21 respectively. At least one of the first supporting seat 1 and the second supporting seat 2 is configured to be movably connected to a surface of the sphere 3 through the corresponding first concave spherical surface 11 or second concave spherical surface 21, and adhered to the surface of the sphere 3 to move with a center of the sphere 3 as a movement center, and an elastic member 4 capable of generating an elastic contraction force is connected between at least one opposite side edges of the first supporting seat 1 and the second supporting seat 2. It can be understood that, in the embodiment, the multi-functional fitness device is provided with the oppositely arranged first supporting seat 1 and second supporting seat 2, which are supported by the sphere 3 therebetween, and at least one of the first supporting seat 1 and the second supporting seat 2 is movably connected to the surface of the sphere 3 through the corresponding first concave spherical surface 11 or second concave spherical surface 21, and can be adhered to the surface of the sphere 3 to move with the center of the sphere 3 as the movement center. A movement mode of the supporting seat comprises that two opposite sides of the first supporting seat 1 and the second supporting seat 2 may be opened or closed (as shown in FIG. 1 to FIG. 3), or the first supporting seat 1 and the second supporting seat 2 may be relatively twisted (as shown in FIG. 6 and FIG. 7). Meanwhile, the elastic member 4 capable of generating the elastic contraction force is connected between the opposite side edges of the first supporting seat 1 and the second supporting seat 2, so as to generate a resistance to movement and a reset force for the relative movement of the first supporting seat 1 and the second supporting seat 2 on the sphere 3. The multi-functional fitness device has a simple and useful overall structure, and there are various exercise modes between the first supporting seat 1 and the second supporting seat 2, so that an exerciser may use the multi-functional fitness device for various exercises. As shown in FIG. 8, any one of the first supporting seat 1 and the second supporting seat 2 may be laid flat on the ground, and then two arms of the exerciser may be supported on the supporting seat far away from the ground to do plank. The exerciser may swing body back and forth towards two sides or exert force by the arms to twist synchronously with the supporting seat supporting the arms as needed, so as to enhance an exercise intensity of the plank. Alternatively, as shown in FIG. 9, the exerciser may do push-up by using the multi-functional fitness device. Alternatively, as shown in FIG. 10 and FIG. 11, when clamping the multi-functional fitness device between thighs, the exerciser may exercise muscles of the thighs by opening and closing movements between the first supporting seat 1 and the second supporting seat 2. Alternatively, as shown in FIG. 12 and FIG. 13, the exerciser may exercise muscles of the arms by the opening and closing movements between the first supporting seat 1 and the second supporting seat 2. Alternatively, as shown in FIG. 14, when the multi-functional fitness device is placed on the ground, the exerciser may sit and put feet on the supporting seat far away from the ground, and exercise the feet by the opening and closing movements or a twisting movement between the first supporting seat 1 and the second supporting seat 2. Alternatively, as shown in FIG. 15, when the multi-functional fitness device is placed on a desktop, the exerciser may exercise the arms by the twisting movement between the first supporting seat 1 and the second supporting seat 2.

In the embodiment, preferably, the first supporting seat 1 and the second supporting seat 2 are configured to be movably connected to the surface of the sphere 3 through the corresponding first concave spherical surface 11 and second concave spherical surface 21 respectively, and can both be adhered to the surface of the sphere 3 to move with the center of the sphere 3 as the movement center. The opening and closing movements or the relative twisting movement between the first supporting seat 1 and the second supporting seat 2 can be more flexible and smooth by such design.

With reference to FIG. 1 to FIG. 7, in a preferred embodiment, two sides of the first supporting seat 1 are respectively provided with a first supporting portion 12 and a second supporting portion 13, and two sides of the second supporting seat 2 are respectively provided with a third supporting portion 22 and a fourth supporting portion 23. The first supporting portion 12 and the third supporting portion 22 are oppositely arranged, the second supporting portion 13 and the fourth supporting portion 23 are oppositely arranged, and the elastic member 4 is connected between the first supporting portion 12 and the third supporting portion 22 or between the second supporting portion 13 and the fourth supporting portion 23.

With reference to FIG. 5 and FIG. 8, in a preferred embodiment, the first supporting portion 12, the second supporting portion 13, the third supporting portion 22 and the fourth supporting portion 23 are all provided with an arc-shaped concave structure convenient for supporting arms of a human body.

With reference to FIG. 1 and FIG. 5, in a preferred embodiment, the arc-shaped concave structures of the first supporting portion 12, the second supporting portion 13, the third supporting portion 22 and the fourth supporting portion 23 are all provided with a flexible pad 5. The flexible pads 5 may support the arms of the human body more comfortably, thus being beneficial for improving exercise comfort. In the embodiment, preferably, the flexible pad 5 may be made of a rubber material or a silica gel material.

With reference to FIG. 5 and FIG. 9, in a preferred embodiment, the first supporting portion 12, the second supporting portion 13, the third supporting portion 22 and the fourth supporting portion 23 are all provided with an opening structure convenient for grasping.

With reference to FIG. 1 and FIG. 5, in a preferred embodiment, a movement trend of mutual approaching and closing formed by the elastic contraction force of the elastic member 4 is configured between the first supporting portion 12 and the third supporting portion 22 or between the second supporting portion 13 and the fourth supporting portion 23. However, those skilled in the art should understand that, in other embodiments, the elastic member 4 may also be mounted between the first supporting portion 12 and the third supporting portion 22 or between the second supporting portion 13 and the fourth supporting portion 23 as needed by the exerciser, so that the multi-functional fitness device is used to do more diversified exercises according to needs of the exerciser.

With reference to FIG. 5, in a preferred embodiment, the first concave spherical surface 11 and the second concave spherical surface 21 are respectively provided with a first embedding groove 111 and a second embedding groove 211 for embedding the elastic member 4, and the first supporting seat 1 and the second supporting seat 2 are also respectively provided with a first fixed clamping position 14 and a second fixed clamping position 24 for fixing end portions of the elastic member 4. It can be understood that, in the embodiment, the end portions of the elastic member 4 are clamped and limited with the first fixed clamping position 14 and the second fixed clamping position 24 to realize fixed connection. However, those skilled in the art should understand that, in other embodiments, the end portions of the elastic member 4 may also be fixedly connected with the first supporting seat 1 and the second supporting seat 2 through other fixed connection structures, which is not limited to the specific implementation disclosed in the embodiment.

With reference to FIG. 4, in a preferred embodiment, a diameter of the sphere 3 is defined as D, and an embedding depth H of the sphere 3 in the first concave spherical surface 11 or the second concave spherical surface 21 is configured as 0.1 D to 0.25 D.

With reference to FIG. 5, in a preferred embodiment, the sphere 3 is a hard spherical structure. In the embodiment, preferably, the sphere 3 is a hard hollow spherical structure made of a plastic material. An overall weight of the multi-functional fitness device may not be too heavy to affect normal exercise by such design, thus being convenient for the exerciser to use.

With reference to FIG. 5, in a preferred embodiment, the elastic member 4 is an elastic rope or an elastic belt, and two ends of the elastic member 4 are both provided with a spherical head 41 for fixing. In the embodiment, preferably, the elastic member 4 is a yarn-covered elastic rope structure, and two ends of the yarn-covered elastic rope are respectively provided with the protruding spherical head 41.

In the description above, the embodiments are only used to illustrate the technical solutions of the present invention, and are not intended to limit the present invention. Although the present invention is described in detail with reference to the above-mentioned embodiments, those of ordinary skills in the art should understand that the technical solutions recorded in the above-mentioned embodiments can still be modified, or some or all of the technical features can be equivalently substituted. However, these modifications or substitutions do not make the corresponding technical solutions deviate from the spirit and scope of the technical solutions of the embodiments of the present invention. Therefore, all other embodiments obtained by those of ordinary skills in the art without making creative works belong to the scope of protection of the present invention.

What is claimed is:

1. A multi-functional fitness device, comprising a first supporting seat, a second supporting seat and a sphere, wherein the first supporting seat and the second supporting seat are respectively provided with a first concave spherical surface and a second concave spherical surface matched with an outline of the sphere, the first supporting seat and the second supporting seat are oppositely arranged, the sphere is supported between the first supporting seat and the second supporting seat, two sides of the sphere are partially fitted and embedded into the first concave spherical surface and the second concave spherical surface respectively, at least one of the first supporting seat or the second supporting seat is configured to be movably connected to a surface of the sphere through the corresponding first concave spherical surface or the corresponding second concave spherical surface, and adhered to the surface of the sphere to move with a center of the sphere as a movement center, and an elastic member configured to generate an elastic contraction force is connected between at least one pair of opposite side edges of the first supporting seat and the second supporting seat.

2. The multi-functional fitness device according to claim 1, wherein two sides of the first supporting seat are respectively provided with a first supporting portion and a second supporting portion, two sides of the second supporting seat are respectively provided with a third supporting portion and a fourth supporting portion, the first supporting portion and the third supporting portion are oppositely arranged, the second supporting portion and the fourth supporting portion are oppositely arranged, and the elastic member is connected between the first supporting portion and the third supporting portion or between the second supporting portion and the fourth supporting portion.

3. The multi-functional fitness device according to claim 2, wherein the first supporting portion, the second supporting portion, the third supporting portion and the fourth supporting portion are all provided with an arc-shaped concave structure convenient for supporting arms of a human body.

4. The multi-functional fitness device according to claim 3, wherein the arc-shaped concave structures of the first supporting portion, the second supporting portion, the third supporting portion and the fourth supporting portion are all provided with a flexible pad.

5. The multi-functional fitness device according to claim 2, wherein the first supporting portion, the second supporting portion, the third supporting portion and the fourth supporting portion are all provided with an opening structure convenient for grasping.

6. The multi-functional fitness device according to claim 2, wherein a movement trend of mutual approaching and closing formed by the elastic contraction force of the elastic member is configured between the first supporting portion and the third supporting portion or between the second supporting portion and the fourth supporting portion.

7. The multi-functional fitness device according to claim 1, wherein the first concave spherical surface and the second concave spherical surface are respectively provided with a first embedding groove and a second embedding groove for embedding the elastic member, and the first supporting seat and the second supporting seat are also respectively provided with a first fixed clamping position and a second fixed clamping position for fixing end portions of the elastic member.

8. The multi-functional fitness device according to claim 1, wherein a diameter of the sphere is defined as D, and an embedding depth H of the sphere in the first concave spherical surface or the second concave spherical surface is configured as 0.1 D to 0.25 D.

9. The multi-functional fitness device according to claim 1, wherein the sphere is a hard spherical structure.

10. The multi-functional fitness device according to claim 1, wherein the elastic member is an elastic rope or an elastic belt, and two ends of the elastic member are both provided with a spherical head for fixing.

* * * * *